US005586340A

United States Patent [19]

Russo

[11] Patent Number: 5,586,340

[45] Date of Patent: Dec. 24, 1996

[54] MULTIFUNCTION SWIMSUIT AND CASUAL WEAR UNDERGARMENT

[76] Inventor: Peter J. Russo, 150 Rockland Rd., Guilford, Conn. 06437

[21] Appl. No.: 318,083

[22] Filed: Oct. 5, 1994

[51] Int. Cl.[6] ..... A41D 7/00

[52] U.S. Cl. ..... 2/67; 2/267; 2/244; 450/31; 450/57; 450/39; 450/97; 450/98

[58] Field of Search ..... 2/2.5, 2, 1, 67, 2/73, 400, 401, 402, 403, 404, 405, 406, 267, 244; 450/30, 31, 32, 39, 40, 53, 54, 55, 56, 57, 97, 98, 99

[56] References Cited

U.S. PATENT DOCUMENTS

| | | | |
|---|---|---|---|
| 1,080,985 | 12/1913 | Leap | 2/267 |
| 2,033,068 | 3/1936 | Galligan | 2/67 |
| 2,075,945 | 4/1937 | Hurt | 2/67 |
| 2,420,575 | 5/1947 | Treadwell | 450/39 |
| 2,659,085 | 11/1953 | Ericson | 450/39 |
| 2,727,278 | 12/1955 | Thompson | 450/39 |
| 3,043,307 | 7/1962 | Weston | 450/38 |
| 3,076,464 | 2/1963 | Rosenberg | 450/97 |
| 3,176,686 | 4/1965 | Burnes | 450/39 |
| 3,295,530 | 1/1967 | Mayer et al. | 450/98 |
| 3,326,218 | 6/1967 | McAlpine | 450/38 |
| 4,916,755 | 4/1990 | Feigenbaum | 450/40 X |
| 5,134,726 | 8/1992 | Ross | 2/267 |

*Primary Examiner*—Jeanette E. Chapman
*Attorney, Agent, or Firm*—Lawrence Hager

[57] ABSTRACT

A garment made of stretch molded material such as rubber or elastermeric resin, such as a swimsuit, with cutouts (front and/or rear) molded in contouring for figure enhancement and having ultra thin seams or no seams to present a more flattering and sensual appearance when used as an undergarment with form fitting casual wear designed to accentuate body parts.

1 Claim, 5 Drawing Sheets

MULTIFUNCTION SWIMSUIT AND CASUAL WEAR UNDERGARMENT

FIELD OF THE INVENTION

The present invention relates to body contouring multifunctional garments and, more particularly, to a garment formed of a molded rubber, resilient resin or other virtually non water absorbent suitable material and to athletic uniforms.

BACKGROUND OF THE INVENTION

During the past decade or so, greater emphasis has been observed in the desire to have clothing aid the wearer in appearing to have a desired typically sexy torso. In addition, more and more effort has been applied toward enabling people greater freedom of expression, versatility of activity with maximum ease and at affordable cost.

The prior art swimsuit is typically a light weight fabric which requires drying before putting on one's outer wear. It is also pointed out that the prior art swimsuit contains seams, ridges, straps, and buckles which are undesirable noticeable if such swimsuit are worn under snugly fitting casual wear.

To avoid the aforementioned disadvantages, it is quite common to see people going to great efforts at the beach to discretely remove a wet bathing suit and put on their casual wear.

The present invention is designed and intended to enable relatively quick dressing at the beach, to virtually eliminate drying of the garment, enable figure enhancing and greater color pattern mix at relatively low cost.

PRIOR ART STATEMENT

The prior art is replete with attempts to provide garments which are flattering to the wearer and/or that provide a functional advantage such as reducing fluid or air drag for better athletic performance.

Prior art references of interest include U.S. Pat. Nos. 4,501,024 issued Feb. 26, 1985 to Peter J. Russo; 4,205,397 issued Nov. 27, 1990 to Leonard J. Rautenberg; 4,205,397 issued Jun. 3, 1980 to Michele Bechis; 4,999,845 issued May 11, 1993 to James E. Jenkes, Jr. et al; 5,033,116 issued Jul. 23, 1991 to Yoshihiko Itagaku et al; 4,916,755 issued Apr. 17, 1990 to Jay Feigenbaum et al; 3,436,762 issued Apr. 8, 1969 to Leslie C. Caha.

None of the above cited references are deemed to affect the patentability of the present claimed invention, and other pertinent prior art may exist.

OBJECTIVES OF THE INVENTION

It is an object of the present invention to provide a new and improved form fitting swimsuit.

It is another object of the present invention to provide a swimsuit which is non absorbent and does not require drying time.

It is another object of the present invention to provide a swimsuit that can readily be wiped dry with a towel.

It is another object of the invention to provide a swimsuit that can be easily wiped dry to enable relatively quick dressing at the beach/pool without changing and without wetting of the outer casual wear.

It is another object of the invention to provide a relatively inexpensive manufacture of swimsuit.

It is another object of the invention to provide a swimsuit having multiple color patterns without seams and costly stitching together of the patterns.

It is another object of the invention to provide a rubber like dual function swimsuit and underwear containing cutouts and/or molded-in figure contouring and enhancing sections.

It is another object of the invention to provide an elastic like non water absorbing garment having figure contouring and/or enhancing and/or accentuating and/or simulating sections integrally formed to eliminate visible seams or telltale signs that the wearer is not personally so shaped or endowed.

It is another object of the invention to provide a snug fitting dual function swimsuit and underwear having molded in seemingly non artificial body parts to aid the wearer's self esteem.

It is another object of the invention to provide a garment having body accentuating and enhancing sections to aid a person to have the feel and look of so called well endowed individuals.

Yet another object of the present invention is to provide a combination wipe dry swimsuit and underwear having a so called glove fit formed of an elastic moldable type material to hold relatively tight about the body contours for maintaining positioning during active use.

Another object of the present invention is to provide a form fitting swimsuit having relatively complex cutout designs at lower cost than possible in the prior art with the elimination of costly seam stitching.

Another object is to provide a swimsuit having cutouts to have the duel function of design and body cooling.

Another object of the present invention is to provide a form fitting molded swimsuit having opaque sections which may be enclosed within a cutout design pattern or section and become transparent when wet.

Another object of the present invention is to provide a more fade resistant and relatively stain resistant swimsuit.

Further objects and advantages will be apparent to those skilled in this art from the following, considered in conjunction with the accompanying drawings.

BRIEF DESCRIPTION OF THE DRAWINGS

Other objects and advantages of the invention will be evident from the following detailed description

DESCRIPTION OF THE PREFERRED EMBODIMENTS

Figure 1:
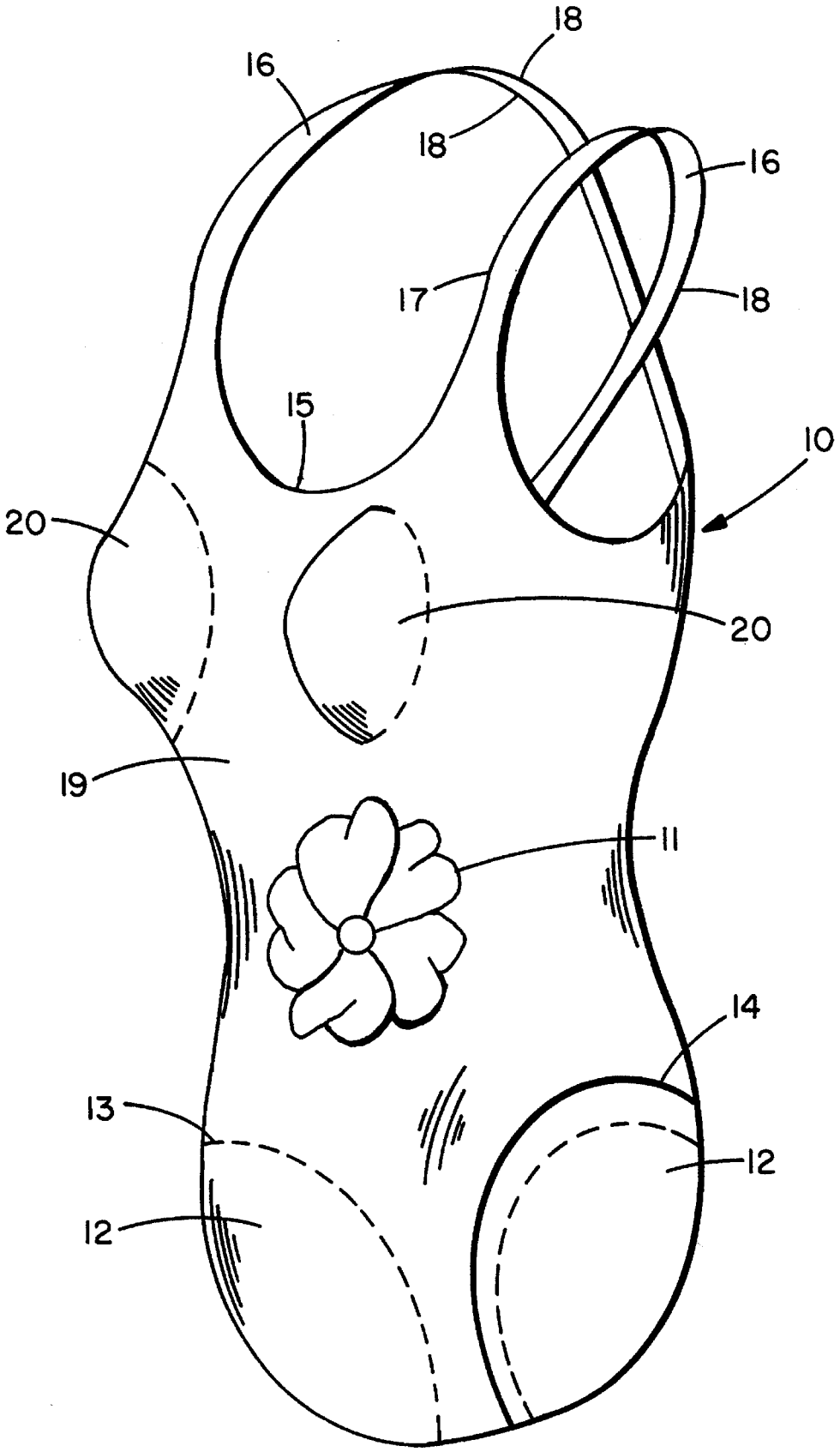
FIG. 1 is a front perspective view of a first embodiment of a woman's swimsuit made in accordance with the present invention to have an intricate design without seams.
Figure 2:
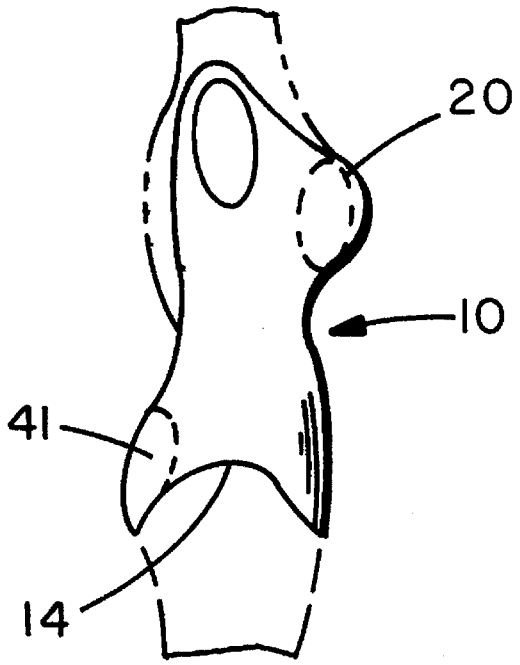
FIG. 2 is a side view of the swimsuit shown in FIG. 1 illustrating in phantom outline the molded in insert figure enhancing sections in accordance with the invention.
Figure 3:
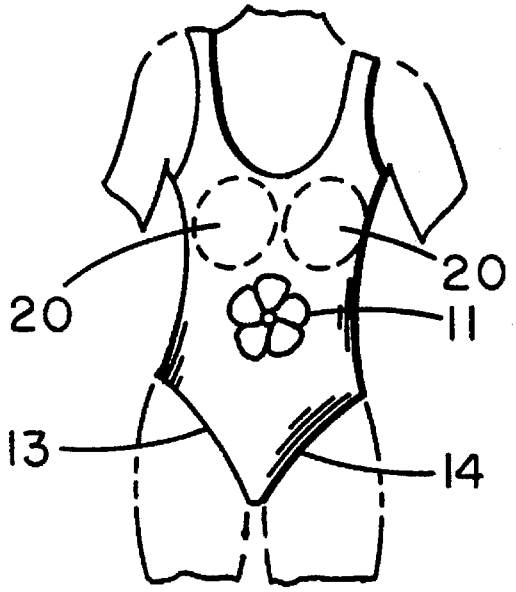
FIG. 3 is a front view of the swimsuit shown in FIG. 1 illustrating in phantom outline the molded in insert figure enhancing sections in accordance with the invention.
Figure 4:
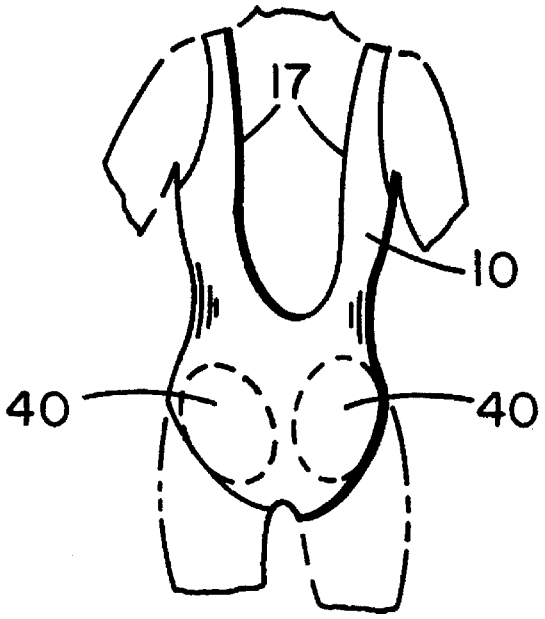
FIG. 4 is a rear view of the swimsuit shown in FIG. 1 illustrating in phantom outline the molded in buttock insert figure enhancing sections in accordance with the invention.

With reference now to FIGS. 1–4 in particular, a woman's swimsuit 10 is illustrated as an embodiment of the invention. As with the men's swimsuit 30 shown in FIG. 5, the women's swimsuit 10 may include multicolor intricate molded in designs 11 and one or more leg cutout sections 12. The edges 13, 14 of the cutout sections 12 and neck 15 and shoulder strap 16 edges 17,18, respectively, are formed in a seamless molded process without the need of stitching. Support straps 16 may also be molded to or bonded, for example, by glue or rubber cement, to the elastic form fitting torso section 19 of swimsuit 10.

Figure 6:
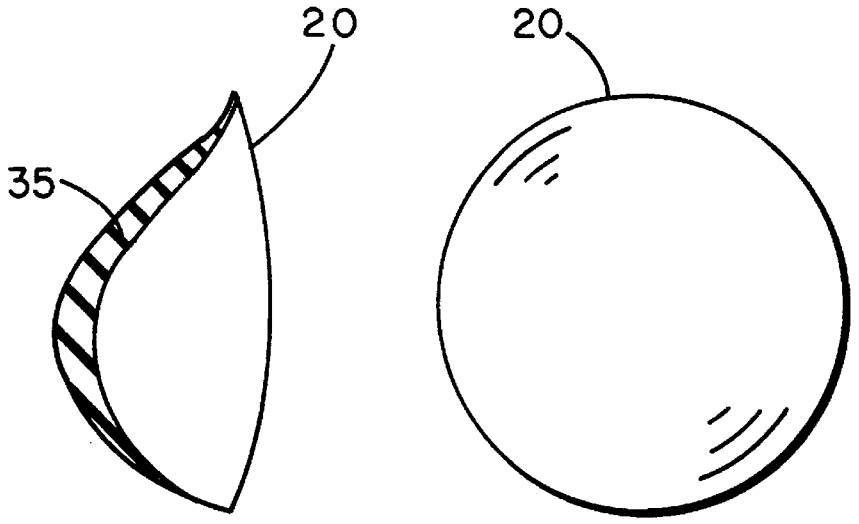
FIG. 6 is a plan view of the breast enhancing inserts illustrated in FIG. 3.
Figure 7:
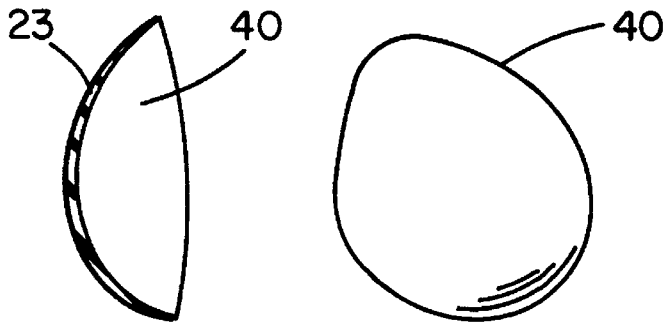
FIG. 7 is a plan view partially in section of the swimsuit buttocks implant enlarging and contouring inserts.
Figure 9:
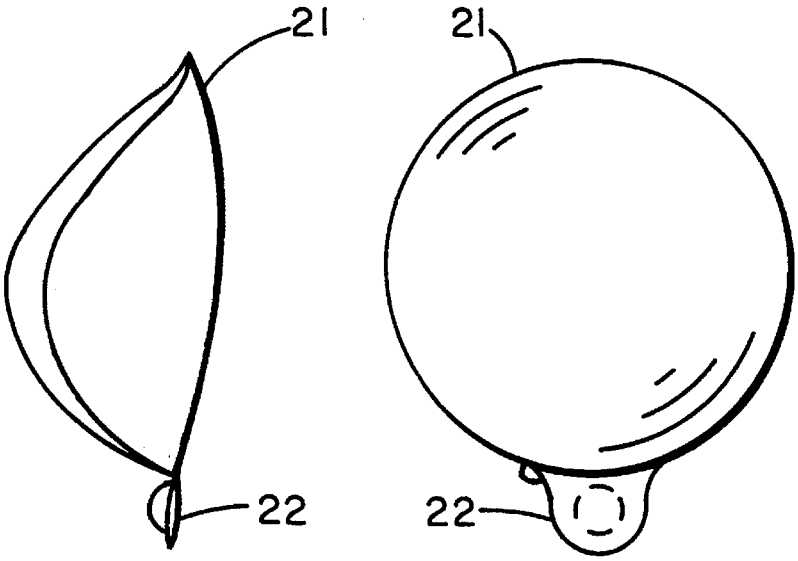
FIG. 9 is a plan view of an inflatable breast enhancing insert illustrated in FIG. 3.

Illustrated in FIG. 6, in cutaway view is shown breast enhancing and/or enlarging implants 20. The breast enlarging implants 20 may comprise molded in sealed air pockets or foam rubber or other suitable sponge material for highlighting and enhancing the desired body areas. Alternatively, the breast enlarging sections may comprise an inflatable balloon like member 21 which can be inflated to a desired size and firmness by means of a conventional valve means 22 as shown in FIG. 9. Thus, an advantageous feature of the invention as applied to a women's swimsuit 10 is that the size and firmness of the accentuated body area may be selectively adjusted and that the enhancing member of the swimsuit 10 is integrally formed with the swimsuit 10 and, therefore, is not subject to be embarrassingly dislodged during athletic or swimming activities.

Figure 10:
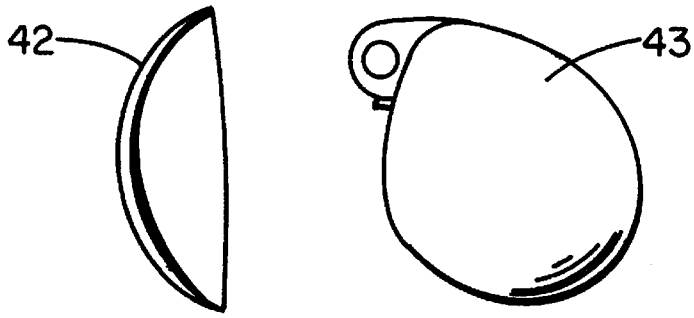
FIG. 10 is a plan view partially in section of the swimsuit buttocks inflatable implant enlarging and contouring insert.

With particular reference to FIGS. 2, 4, 7 and 9, shown in phantom outline are buttocks enhancing pads/pockets 40 or cutout sections 41, of the women's swimsuit 10. Each buttocks enlarging member 40 may comprise one or more air chambers 42, shown in FIG. 10 or a contoured padded member made of suitable material such as a foam rubber 23 or silicon (not shown). As with the breast enhancing members 20,21, the buttocks padding members may be molded into the swimsuit 10 to prevent dislodgement, and are pressurized or padded to have a desired firmness and contour to provide a desired enhancing and accentuating appearance.

The inflatable breast enlarging members 21, provide a particularly unusual yet highly desirable buoyancy advantage to the wearer of the swimsuit 10. For example, the wearer is not only aided by the buoyancy of the inflatable breast and/or inflatable buttocks members 42,43, while swimming, but her enhanced figure is further accentuated by, for example, the buoyancy of the breast members 21 while she floats on her back or does a back stock style swim activity.

From the above it should be recognized that the form (snug) fitting elastic and/or rubberized and elasticized type swimsuit according to the invention may be formed of any suitable material for being waterproof and wipe dry. In this manner the dual function swimsuit and undergarment may be used not only to enhance the wearer's figure during swimming and athletic activity, but enables virtually immediate casual wear dressing without necessity of removing the swimsuit. Thus, the perfect shape illustration may be maintained, for example, at the beach and afterward during other activities.

Figure 5:
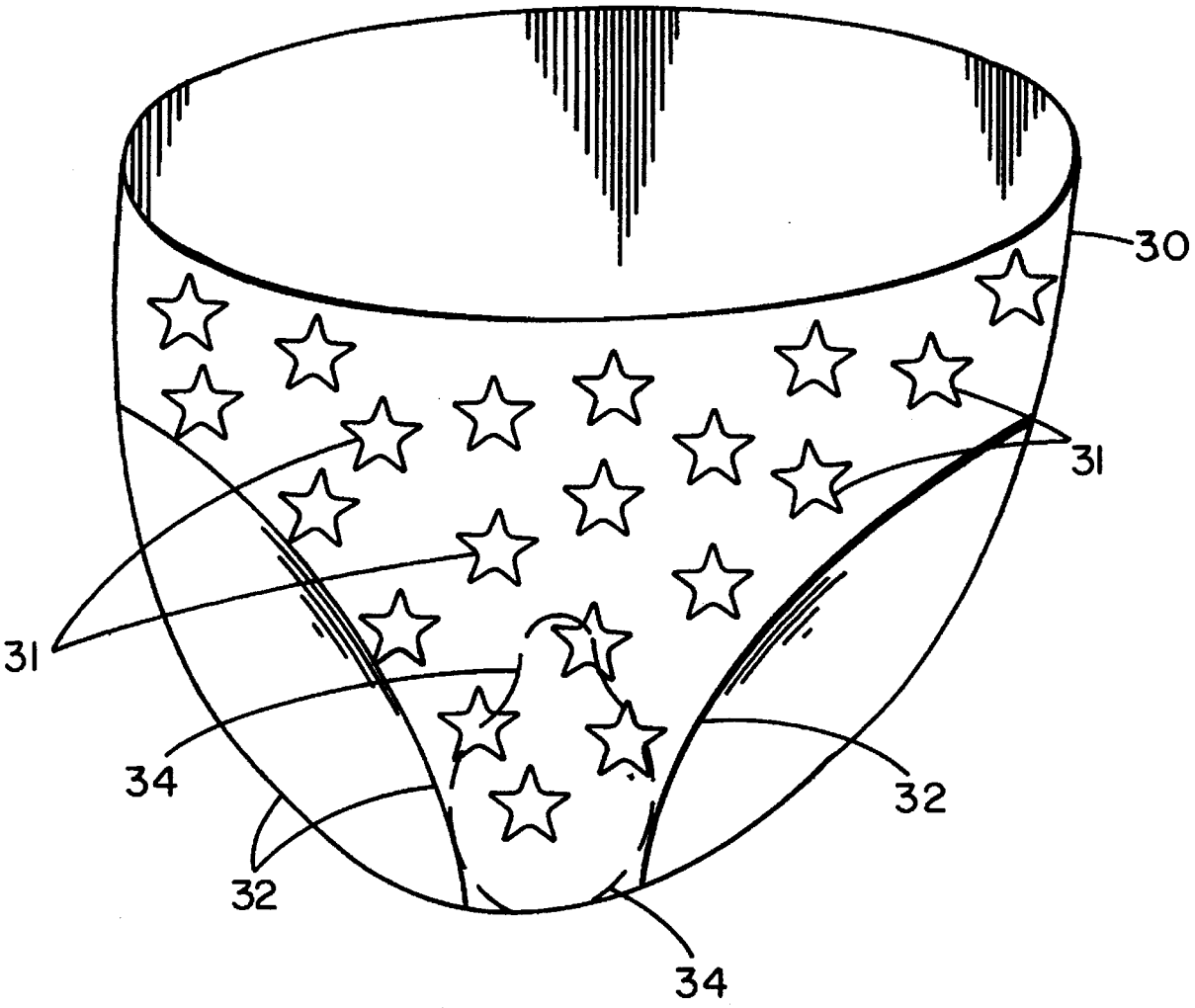
FIG. 5 is a front perspective view of an alternative embodiment in a man's swimsuit and/or body suit with buttocks enhancing insert sections.
Figure 8:
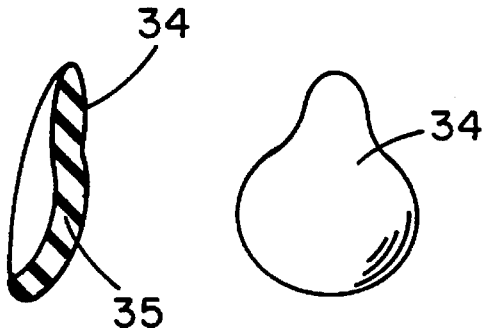
FIG. 8 is a plan view partially in section of the swimsuit jock implant enlarging and contouring inserts.
Figure 11:
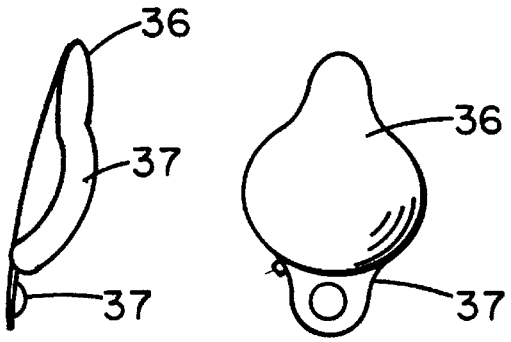
FIG. 11 is a plan view partially in section of the swimsuit an inflatable jock implant enlarging and contouring inserts.

With reference to the drawings in general and, in particular, to FIGS. 5, 8 and 11, a man's type swimsuit 30 made in accordance with the present invention is illustrated. The preferred material for the men's and woman's swimsuit is a waterproof, elasticized molded rubber or latex neoprene. Other moldable types of material may also be suitable without departing from the spirit of the invention such as, for example, stretchable resins and plastics which can be molded to the desired shape.

The technology related to a molding process is well known in the prior art and a detailed discussion thereof is omitted to avoid prolixity.

As previously noted, one of the features of the invention is the provision of a swimsuit having multicolored design patterns 31 molded into the rubber or latex neoprene during the suit manufacturing, i.e., molding process. The relatively intricate design 31 may be formed using many different colors, for example, red, blue, yellow, and other colors, without the need to sew the color designs onto a suit and without costly and laborious and bulky seams. The actual design selected may comprise various symbols, cutouts, pictures, or the entire swimsuit may comprise, for example, a colage or the appearance of a multicolored so called finger painting. Such intricate and multicolored designs 11,31 can be relatively inexpensively formed during the molding process without seams.

Another feature of the invention is that the molded-in multicolored designs are relatively fade resistant and stain resistant.

With particular reference now to FIG. 5, a design pattern 31 is formed on the swimsuit 30. The design pattern 31 is provided by way of illustration only and other intricate designs may be utilized. A feature of the present invention is the ability to have many varied swimsuit which incorporate different colored and/or cutout sections 12 at relatively low cost of manufacture. In addition, it should be noted that in accordance with the present invention the borders 14,17, 18,32 defining the cutout designs do not require stitching which reduces manufacturing defects and enables relatively more intricate design flexibility than hitherto possible in swimwear. The cutout pattern may be accentuated with colored regions for a more dramatic presentation.

With reference now to FIG. 8 a jock insert section 34 of the swimsuit shown in FIG. 5 is illustrated. The jock insert member 34 may comprise a molded rubber 35 like cup shaped member which is bonded to the swimsuit or integrally formed therewith. The size, firmness, thickness and form may be predetermined to meet the needs and desirers of the potential customers for such items. For example, the insert may be contoured to give the appearance of a large penis beneath a swimsuit. Another feature and advantage of the present invention comprises an inflatable enhancing padded like jock member 36 molded in or bonded to swimsuit 30. The padding effect may be formed, for example, by a trapped air pocket 38 selectively inflatable to a desired firmness by means of a conventional type valve 37. The molded or bonded in padded jock support 34 not only provides an enhancing contour to the wearer's physic but also provides protective padding for safer athletic activity. It is pointed out that since the padded support jock member 34,36 is integrally molded with or bonded to swimsuit 30, possible dislocation thereof is substantially reduced or virtually eliminated. In addition, the pneumatic and/or hydraulic pressure within and, thereby, the accentuating and tactile perceptive effect thereof may be predetermined during manufacture. Valve 37 may be provided to enable the wearer to customize the inflation level and firmness of the jock support. Support valve 37 may be of conventional design.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

What is claimed is:

1. A dual purpose molded swimsuit and undergarment for being worn by a person, comprising:

a resilient waterproof, elastomeric material being contoured for tightly encasing at least a portion of the person's torso, including a portion of the abdomen, hips, crotch, bosoms and buttocks area, and having portions defining a pair of legholes;

a prosthetic bra means being secured within the swimsuit at the front bosom regions and valve means for enabling selective pneumatic pressurization of each of said prosthetic bra bosom regions to a size and pressure for wearer customizing and selective enlargement of each of the bosom bulge regions of said swimsuit for selectively enhancing at least one bosom bulge swimsuit contour to a wearer selected size and for providing increased buoyance to the wearer of said swimsuit to facilitate floating and swimming activities, said swimsuit material being molded to form a relatively fade and stain resistant design pattern without stitched seams;

the prosthetic bra means being integrally formed with the swimsuit and undergarment to have a sealed pocket section and a valve means to enable air to be put into said pocket to a pneumatic pressure in excess of the ambient air pressure; and a relatively intricate and colorful design member being integrally molded into the elastic material;

and a pair of prosthetic pneumatically inflatable buttock enlarging members integrally molded into said swimsuit and undergarment;

at least one cut out section of selected design for revealing predetermined torso sections of the wearer.

* * * * *